US005788406A

United States Patent [19]

Hernandez

[11] Patent Number: 5,788,406

[45] Date of Patent: Aug. 4, 1998

[54] DOUBLE PIVOT SEMI-AUTOMATIC MANHOLE COVER LIFTING DEVICE

[75] Inventor: Manuel Andres Hernandez, Anaheim, Calif.

[73] Assignee: S. Bravo Systems, Inc., Buena Park, Calif.

[21] Appl. No.: 921,729

[22] Filed: Aug. 27, 1997

Related U.S. Application Data

[63] Continuation of Ser. No. 633,929, Apr. 17, 1996, abandoned.

[51] Int. Cl.[6] ..... E02D 29/14

[52] U.S. Cl. ..... 404/25; 49/387; 52/19

[58] Field of Search ..... 404/25, 26; 52/19, 52/20, 21; 49/246, 345, 386, 387

[56] References Cited

U.S. PATENT DOCUMENTS

| | | | |
|---|---|---|---|
| 1,096,323 | 5/1914 | Sherman | 110/176 |
| 1,951,534 | 3/1934 | Schwitzer et al. | 220/36 |
| 1,992,354 | 2/1935 | Coleman | 404/25 |
| 2,564,988 | 8/1951 | Muller | 20/16 |
| 2,763,900 | 9/1956 | McAfee et al. | 20/16 |
| 3,051,280 | 8/1962 | Bergman et al. | 189/46 |
| 3,184,099 | 5/1965 | Gravert | 220/55 |
| 3,567,263 | 3/1971 | McKinney | 292/241 |
| 3,907,348 | 9/1975 | Bates et al. | 292/220 |
| 4,145,843 | 3/1979 | Lyons | 49/386 |
| 5,289,615 | 3/1994 | Banks et al. | 16/366 |
| 5,451,119 | 9/1995 | Hondulas | 404/26 X |
| 5,507,590 | 4/1996 | Argandona | 52/20 X |

FOREIGN PATENT DOCUMENTS

| | | | |
|---|---|---|---|
| 3711338 | 10/1988 | Germany | E05F 3/00 |
| 1509 324 | 5/1978 | United Kingdom | 49/246 |

*Primary Examiner*—James Lisehora

*Attorney, Agent, or Firm*—David L. Hoffman; Cislo & Thomas LLP

[57] ABSTRACT

A device to assist in the opening of a manhole cover has a biasing member such as a spring and a pivot rod or rods. The rods and spring are each pivotably attached to first and second mounting brackets. The first mounting bracket is attached to a skirt for seating the manhole cover and the second mounting bracket is attached to the underside of the cover. The spring acts to rotate the manhole cover in a reverse direction to which the cover is intended to be opened until the cover contacts the rod or rods. Then, the cover is rotated in an opposite direction, preferably with manual assistance, using the rods as pivot arms.

17 Claims, 5 Drawing Sheets

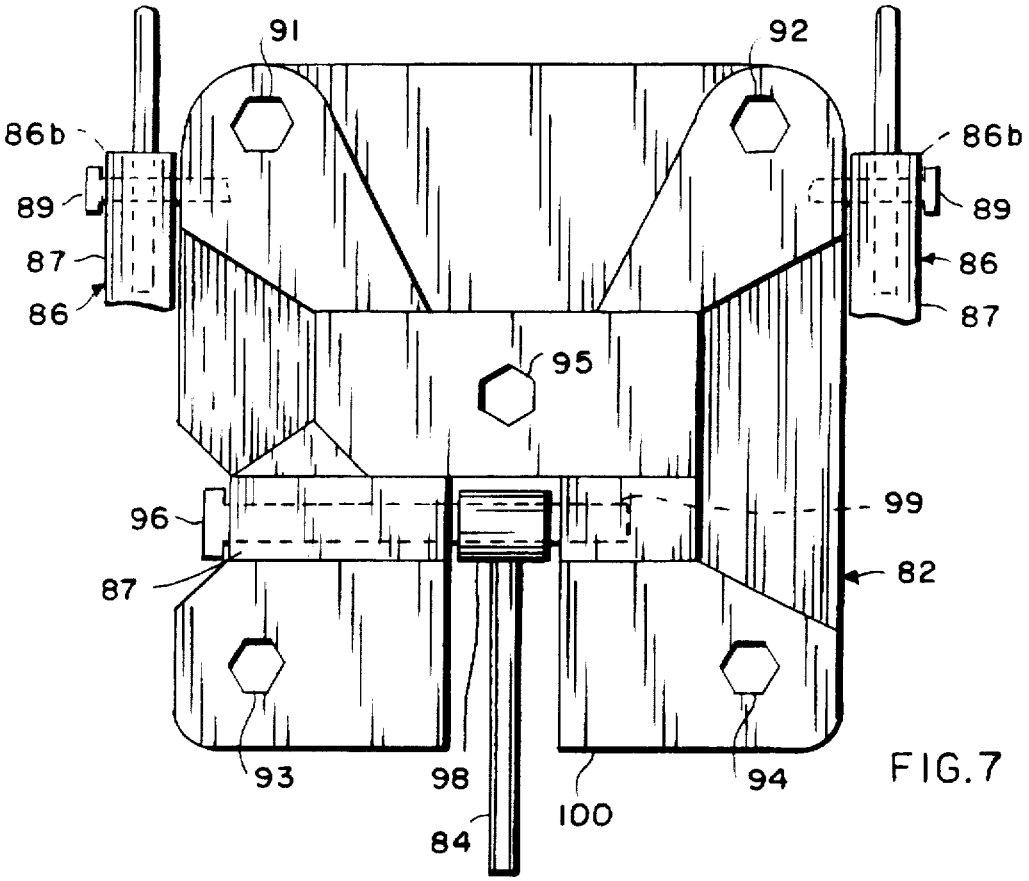
FIG.7
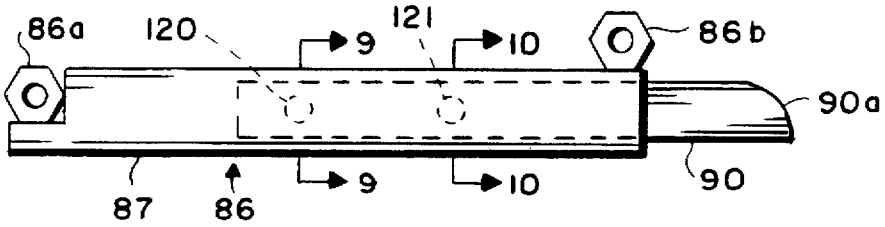
FIG. 8
FIG.9
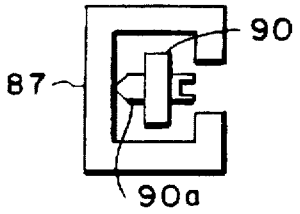
FIG.10
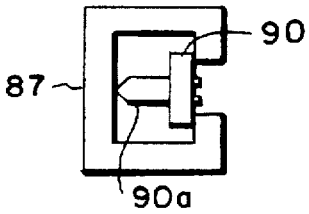

DOUBLE PIVOT SEMI-AUTOMATIC MANHOLE COVER LIFTING DEVICE

This is a continuation of application Ser. No. 08/633,929 filed on Apr. 17, 1996, now abandoned.

BACKGROUND OF THE INVENTION

The present invention relates to a manhole cover opening device.

Manhole covers generally are made of cast iron and weigh about 200 to 300 pounds. They are used at service stations to cover gasoline tank filling pipes, submersible pumps, and other equipment, devices and access ways. Periodically, it is necessary to lift a manhole cover for maintenance, service, inspection or otherwise. Due to the weight of the cover, service personnel normally must work in pairs to help ensure safe handling of the cover.

Recently, attempts have been made to solve the problem of safely and easily opening and closing a manhole. The devices proposed, however, are very expensive and difficult to install as they may require a specially shaped or hinged manhole cover and may require breaking the concrete surrounding the manhole. The devices also tend to include expensive components such as roller mechanisms, hydraulic mechanisms and other high maintenance elements. For example, German Patent No. DE3711338 shows a piston-like lifting element and swing arms attached to a cover. The swing arms are pivotably mounted outside the footprint of the cover and this would require breaking concrete and a special skirt for seating the cover. The device must be locked in the closed position with a toggle to keep the cover in the closed position.

U.S. Pat. No. 5,451,119 to Hondulas discloses a spring-biased cover which is hinged to a frame, and a latch to hold the cover closed against the spring force. Specifics of the structure are vague and it appears that the hinge and spring will interfere with each other.

The difficulty in designing an inexpensive, easy-to-install and retrofittable system is in part due to the problem of trying to pivot the manhole cover about a point along its circumference or hinging the manhole cover itself. Moreover, if the device is to be retrofittable on existing covers, there is relatively limited space to install it.

SUMMARY OF THE INVENTION

In one embodiment, the invention provides a manhole cover which actually initially is rotated away from the direction of desired rotation with the assistance of a spring in order to shift the center of gravity of the cover to a position from which the spring now acts to rotate the cover back in the desired direction. The invention also includes a first mounting bracket to mount one end of the spring to a manhole skirt and a second end to the cover. A pair of stopper bars are pivotably mounted to each bracket. The spring biases the cover to rotate away from the first mounting bracket about the covers's edge remote from the first mounting bracket, until the underside of the manhole cover contacts the stopper bars. The spring then urges the cover to rotate about the pivot axis at which the bars are fixed to the first bracket.

To operate the device, a handle on the cover is lifted and the manhole cover starts to rotate away from the first bracket.

Continuing to pull on the handle, the spring starts to rotate the cover and stopper bars in the opposite direction to that which the cover was initially rotating, once the stopper bars are contacted.

The spring causes the cover to rotate fully open and may also cause the cover to rotate its position about the stopper bars.

The amount of force needed to open the cover is controlled by setting a variety of factors including the spring force, the spring initial length, the length of the stopper bars, positions of attachment of each bar and the spring, and other factors. The stopper bars' length is preferably adjustable, as well as the spring tension. It is also preferable to set the spring force to assist opening, rather than requiring a lock to hold the cover closed. However, this is not a requirement of the invention. Furthermore, it is preferable to use a mechanism to limit the amount that the cover will open, which will help avoid accidents.

BRIEF DESCRIPTION OF THE DRAWINGS

The invention will now be described in detail below in reference to the drawings in which:

FIG. 7 is a bottom view of the second mounting bracket showing connections of ends of the pivot arms and the spring assembly;

FIG. 8 is a side view of one pivot bar;

FIG. 9 is a vertical sectional view along line 9—9 of FIG. 8, showing a first position in which a slide bar in the pivot bar is movable;

FIG. 10 is a view similar to FIG. 9 with the slide bar in a second, non-movable position.

DESCRIPTION OF THE PREFERRED EMBODIMENT(S)

Figure 1:
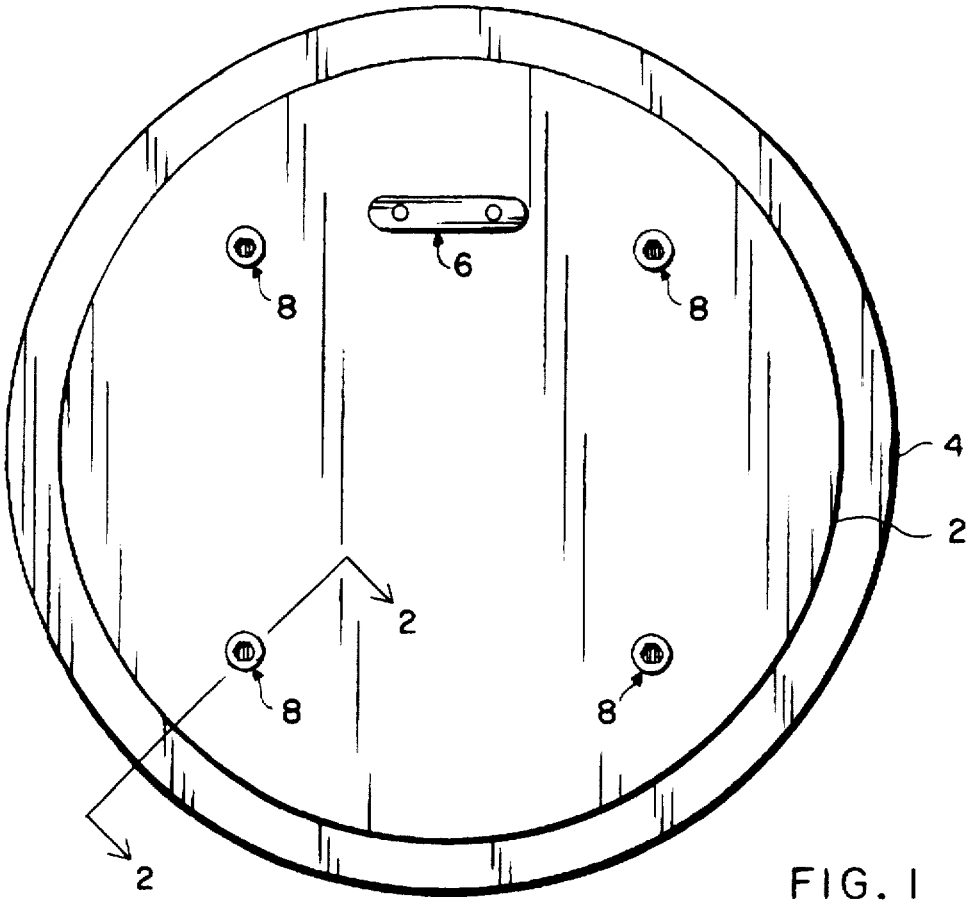
FIG. 1 is a top view of a manhole cover seated in a skirt and having a handle suitable for use with the invention.

In accordance with the invention, a manhole cover is biased open. With reference to FIG. 1, a manhole cover 2 is seated on a shoulder of a skirt 4. The cover has a handle 6 to simplify lifting and replacing it.

Figure 2:
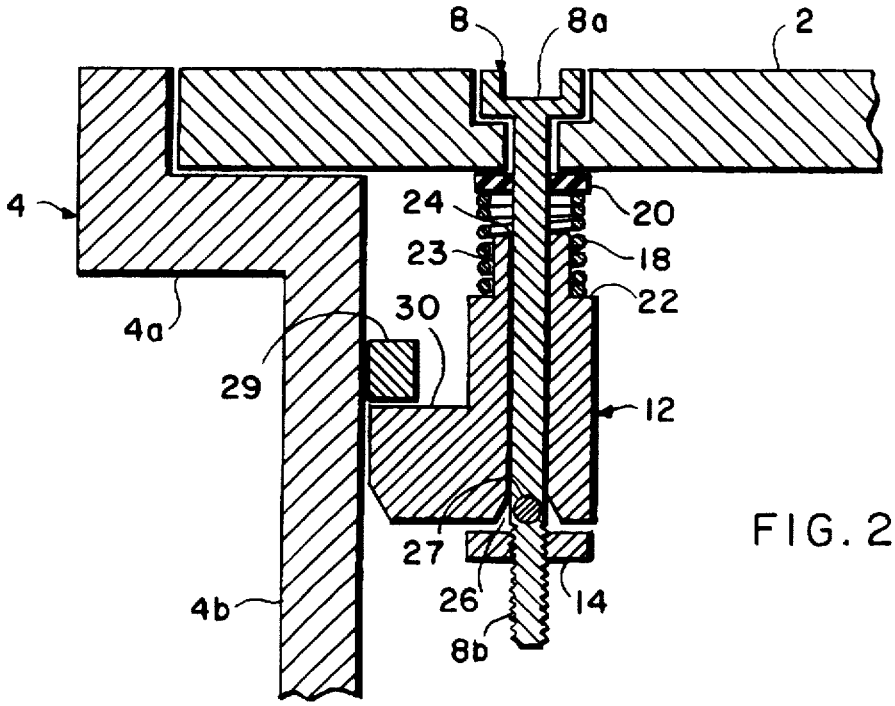
FIG. 2 is a partial vertical sectional view of the cover and skirt of FIG. 1 taken along a line 2—2 of FIG. 1 showing a cam locking device which may be used with the invention.
Figure 3:
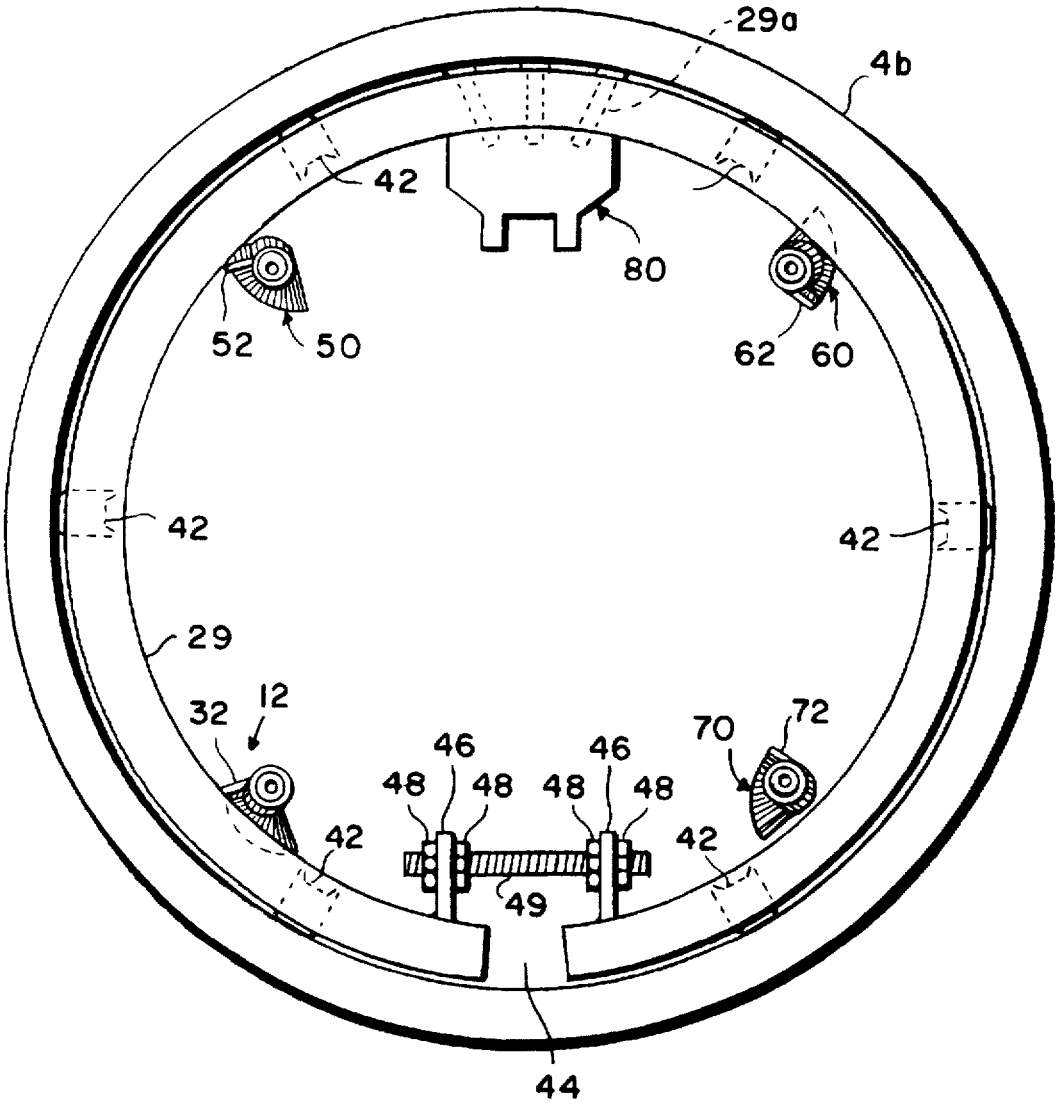
FIG. 3 is a top view of the skirt with cover removed showing various positions of the locking device which may be used with the invention and a set ring and a first mounting body for use with and in accordance with one embodiment of the invention.

In a preferred embodiment, the cover may be provided with a locking device as shown in FIGS. 1 through 3 and as disclosed and explained in detail in a co-pending U.S. Application filed Apr. 15, 1996 and entitled LOCKING DEVICE FOR MANHOLE COVER, invented by Sergio M. Bravo, which application is hereby incorporated by reference.

Basically, the locking device includes four bolts, each having their heads 8*a* sunk into the top of the cover. The shank 8b of each bolt passes through the cover and a through-hole 24 in a cam body 12. A nut 14 threaded to the lower end of the bolt supports the underside of the cam body. There is a spring 18, and a washer 20 mounted on shaft 8b of the bolt. The spring fits around an upper portion 23 of cam body 12 and presses against shoulder portion 22. A groove 26 or hole is formed through the cam body and at pin 27 passes through the groove into a through-hole formed in bolt 8, to rotate body 12 with bolt 8. Generally, the locking device is rotatable so that a cam surface 30 which extends part way around the cam body 12 will engage or disengage from an underside of a projection 29 fixed to or integral with a cylindrical portion 4b of the skirt. If the skirt does not already have such a projection, a suitable ring 29 of cast aluminum, iron or other strong material may be provided. Six set screws 42 provide a way to fix the ring 29 to the interior wall of the skirt. The ring circumference is preferably adjustable. This adjustability is provided by a gap 44 in the ring and an adjustable connection bridging the gap. The adjustable connection is formed by two flanges 46 welded or otherwise fixed to the ring. Each flange has a through-hole through which a threaded rod 49 passes. Nuts 48 are threaded onto the rod 49 and thus are movable to open or close the gap 44 as needed.

The cam body 12 has a stopper 32 which serves to limit rotation of the cam body to ensure that the cam body is moved only to an open or locked position as desired. The cam surface 30 has higher and lower portions. Three other cam bodies 50, 60 and 70 are shown in various rotational positions in FIG. 3 and are identical to cam body 12. Cam body 12 is shown in the locked position where surface 30 engages the underside of ring 29. Cam body 60 is shown in a rotational position where its stopper 62 is not contacting ring 29, but a sufficient portion of its surface is underneath ring 29 so that it will lock cover 2 from being removed. Cam body 70 is shown in unlocked position where surface 30 is clear of ring 29 and its stopper 72 is not against ring 29. Cam body 50 is shown in an unlocked position with its stopper 52 contacting ring 29 to show the limit of rotation of the cam body to the unlocked position. With this structure, it is only necessary to turn the cam body by turning the bolt approximately one quarter of a turn in order to securely lock or unlock the cover.

Figure 4:
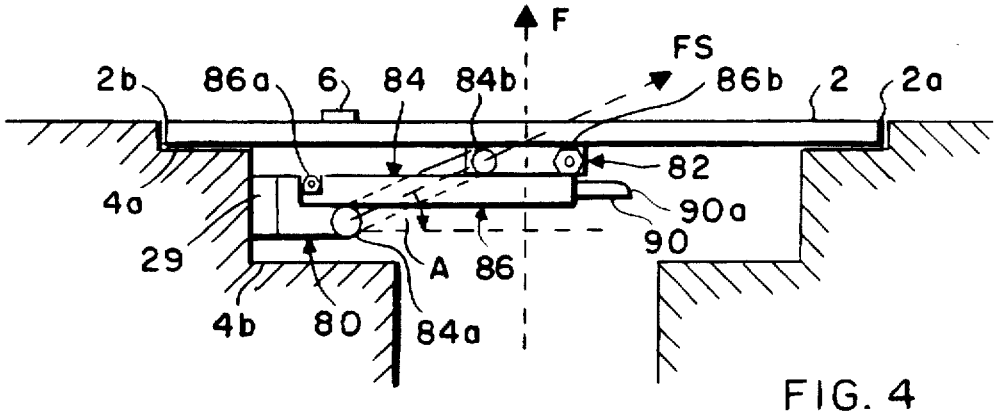
FIG. 4 is a partial schematic, partial side view of the cover, the set ring, the first mounting bracket, a second mounting bracket, a spring assembly and a pivot arm, with the cover in seated position on the skirt, for illustrating an embodiment of the invention.

The lock may be used with an embodiment of the invention which is shown in FIG. 4. Basically, the ring 29 or a ring identical thereto provides a way to fix a first, lower mounting bracket 80 to the skirt. A second, upper mounting bracket 82 is fixed to the cover at the cover's underside. The first and second brackets provide a way to pivotably fix first and second ends 84a, 84b, respectively of a spring assembly 84 shown partly in dashed lines. Thus, the spring assembly can rotate with respect to either bracket.

One pivot bar assembly 86 is also rotatably fixed at each end to the first and second brackets 80, 82. Mounting elements 86a, 86b at each respective end of pivot assembly 86 are used for this purpose. The pivot assembly 86 is formed by a C-channel bar 88 and an extension rod 90. Preferably, the second end 84b of the spring assembly is so that the direction of the spring force points to the center of gravity of the cover. This is shown by the intersection of lines FS and F. The upward component F of this spring force FS will thus tend to urge the cover 2 to rotate about its end 2a. The spring force FS is preferably less than the amount necessary to automatically open the cover, unless a lock for the cover, such as described above, is provided. For example, for a 185 pound cover with an angle A of 6.7 degrees, FS would be 1,586 pounds (approximately) to be equivalent in its upward force F to the weight of the cover. Even with a lock, it is preferred to have a spring force lower than needed to automatically open the cover, but enough to provide substantial assistance.

Figure 5:
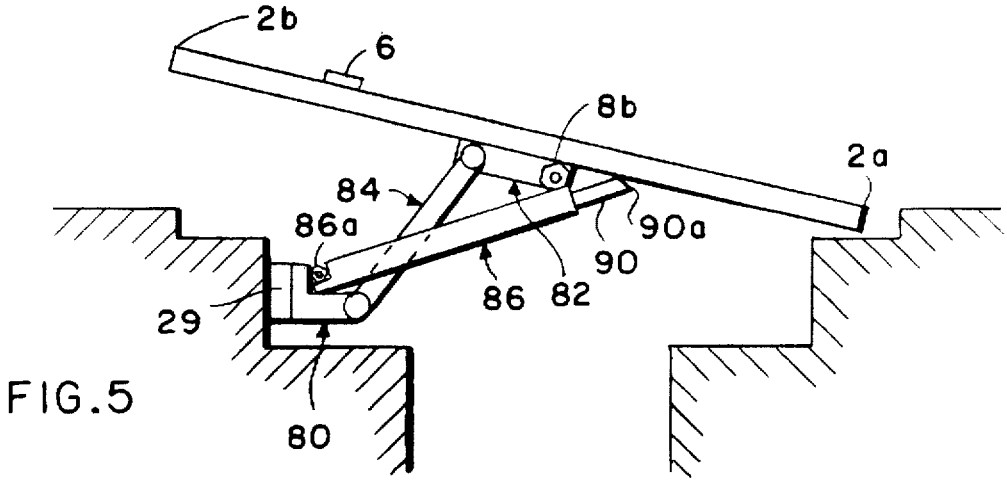
FIG. 5 is a view similar to FIG. 4 but with the cover in a partially open position.

When the cover is unlocked and handle 6 is lifted, the cover tends to rotate about end 2a as shown in FIG. 5. The cover will rotate until it contacts and is stopped by extension rod 90. At this position, which depends upon a variety of factors including the weight of the cover, the spring force, the position of the extension rod, pulling handle 6 towards circumferential point 2b will now cause the pivot rod assembly 86 to rotate counter clockwise in FIG. 5 about rotatable mounting element 86a. Handle 6 may be pulled until the cover contacts the ground. Alternatively, a stopper mechanism may be used to prevent the cover from hitting the ground such as by the installation geometry of the spring arm assembly and pivot rod assembly in relation to the ring 29 or skirt 4. The position of the extension rod 90 may be adjusted, as described later, to assist in connection with this goal. In addition, the spring force may be adjusted as described later.

Details of the invention will now be described with reference to FIGS. 7 through 11. The second, upper mounting bracket 82 has five bolts 91–95 through it which pass through the underside of the cover and are fixed thereto with nuts. The bolt 95 is preferably at the center of gravity of the cover 2. For accurate installation of the mounting bracket 82, a template may be used. The bracket may be made out of a suitable plastic or cast aluminum or iron. The bracket need not be formed in one piece.

The bracket provides a place for pivotal attachment of each of the parallel pivot bars 86, 87 at rotatable mounting elements 86b, e.g., cut rod. Bolts 89 fasten the elements 86b to the bracket. A bolt 96 passes through a through-hole 97 and receives a rod 98 so that the rod will be rotatable with respect to the bolt. The bolt threads into a hole 99 in the bracket.

A spring guide rod 100 is fixed to the rod 98. The first, lower mounting bracket 80 has mounting elements 86a rotatably attached thereto by bolts 102 threaded into the first bracket, which is, preferably made of the same materials as the second bracket. With this construction, the bar 87 is rotatably mounted at each end. The elements 86a, 86b may be integrally attached or unitary with bar 87. Three bolts 29a passing through ring 29 and into bracket 80 hold the bracket against the ring, the bracket having a curved surface 80a to mate with the ring.

The spring assembly has another rod 103 for pivotably mounting to bracket 80 by means of a bolt 105. The rod 103 is unitary with or welded to a rod 104 having a threaded end 106. Threaded end 106 receives a nut 108 which is a tensioning nut for a spring 110 of the spring assembly. Moving the nut back and forth on rod 106 will increase or reduce tension of the spring as desired to fit the particular installation geometry and force desired to assist in opening the manhole cover. The rod 104 may extend inside rod 100 and thus the rods 104, 100 telescope with respect to each other to adjust the length of the spring guide rod and to allow the assembly to fit different size manholes and different installation geometries. The rod 100 may be provided with parallel grooves which allow bolts 111, 112 to pass therethrough and thus fix the rods relative to each other by tightening nuts 113, 114. Inner rod 104 would preferably have holes in it to prevent movement of the rod. The bolts thus pass through an appropriate hole 104b, 104c in rod 104. One of the bolts 111 may be used also as a stopper for a washer 118 which is a surface against which the spring 110 can act. With reference to FIGS. 8 through 10, rod 90 preferably has a rounded end 90*a* for mating with the cover 2 during the opening process. Extension rod 90 is adjustably mounted in bar 87 which is preferably a C channel member. Two set screws 120, 121 when tightened press bar 90 against the ends of the C channel, as shown for screw 121 in FIG. 10, to lock the bar in place. As shown in FIG. 9, each set screw is loosened to allow the rod 90 to slide in the C channel and thus adjust its length.

Figure 6:
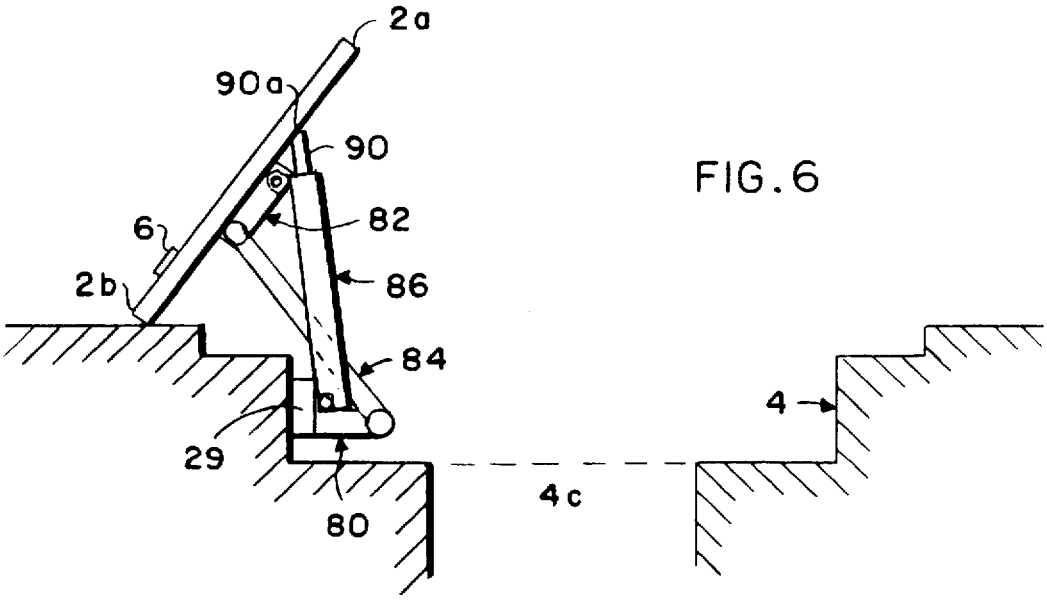
FIG. 6 is a view similar to FIG. 5 with the cover in fully open position.
Figure 11:
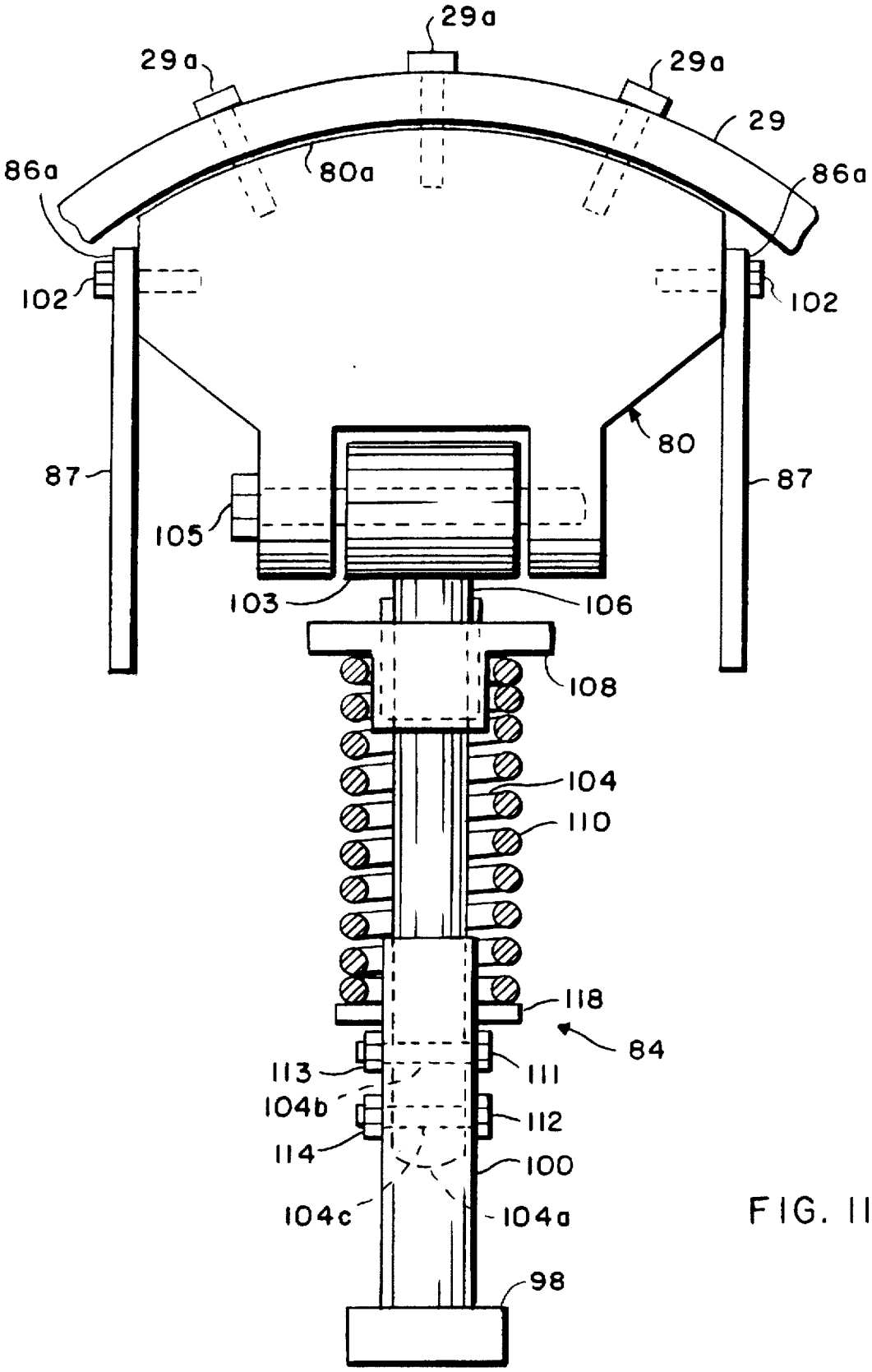
FIG. 11 is a top view of the first mounting bracket, pivot bars and spring assembly attachment, and the attachment of the first mounting bracket to the set ring.

As shown in FIG. 6, if one wants to adjust the ending position of the cover 2, extension rod 90 can be retracted somewhat into bar 87 which would move the position of the cover 2 clockwise in FIG. 6 and leave point 2*b* up in the air. The limiting factor in FIG. 6 with regard to opening would then be where assembly 86 contacts ring 29 as shown in FIG. 6. The cover ending position can thus be made to avoid hitting someone's foot. Additionally, if the surface surrounding the manhole is sloped, it may be desirable to further adjust the position of rod 90 in either direction.

The resulting device is readily installed on a new manhole installation or retrofit onto existing manholes. It is easy to install and fits within relatively limited vertical space. For example, in many applications, the space between shoulder 4*b* and cover 2 (FIG. 4) may be only two or three inches. To obtain a strong enough pivot force with a spring or other biasing member to pivot about edge 2*b* of cover 2 would be impractical to install in such limited space. As noted previously, prior solutions to the problem included breaking through the concrete and skirt or providing a specially hinged cover, or a cover on rollers. Because the spring of the present invention acts in, initially, a direction of rotation of the cover 2 opposite to what is intended ultimately, the end 2*b* may be moved out of the way of the seat of the cover and pivot assembly 86 may be established as a pivot for the cover. Once the spring assembly 84 and cover reaches the position of FIG. 5, extension rod 90 contacts the cover and this arrangement is essentially set or fixed due to the force of the spring 84. In order to elongate further, spring 84 tends to urge cover 2 to pivot about point 90*a* of contact, but since this cannot happen, the cover 2 stays in its position with respect to assembly 86. The spring will still tend to further elongate and provide an assisting force but now rotating the assembly counter clockwise using handle 6 pulling it toward the user. As the entire assembly moves counter clockwise, the spring elongates further because of the placement of its pivot points in relation to the pivot points of assembly 86.

To fix the final point of opening, a kind of lock open mechanism can be used. For example, two rigid elongated members can be hinged together and their remote ends can be hinged respectively to the first and second mounting brackets. The members can then be positioned such that opening the cover rotates them and the amount of rotation can be limited to 180 degrees with respect to each other. This hinge assembly may also be used to hold the cover in the open position so that it does not accidentally tend to close.

The arrangement of the pivot points of the spring and pivot bars at the first bracket which is adjacent the skirt and the circumference of the cover allows the entire assembly and cover to be pivoted out of the way of the central opening 4*c* of the manhole assembly as shown in FIG. 6. This allows access.

In FIG. 4, to determine a desired spring force FS, angle A between the horizontal and the spring, and the weight (W) of the manhole cover are first selected or determined.

A typical cover may weigh 185 lbs and A has been selected as 6.7 degrees for this example. Therefore, if the desired upward force component F is selected to be 185 lbs so that the cover will essentially float, and if the spring is aimed to provide force in a direction to intersect with the center of gravity of the cover, the spring force must be about 1,586 lbs (WsinA). However, a force of less than that is preferred. More force may also be used as long as there is a mechanism to keep the cover closed.

The spring needs to act to rotate the cover away from the desired final open position of the cover, so that the cover will contact and stay in contact with the pivot bars and in this embodiment, that requires attaching the spring so that it acts on the center of gravity of the cover or on the side of the center of gravity where the spring is located. The handle should also be on that side. The cover can then be readily reverse pivoted.

What I claim is:

1. A manhole cover opening device for opening a manhole cover seated in a skirt, the device comprising:

a pivot rod having a first end, a second end, and an intermediate point proximate to the second end;

first means for pivotably attaching said first end of the rod to the skirt;

second means for pivotably attaching said intermediate point of the rod to the cover and for locating said second end proximate to the cover;

a biasing member pivotably attached to the first means and to the second means, the biasing member being adapted for acting to initially rotate the cover in one direction about an edge of the cover until the cover contacts said second end of the rod, whereby the rod is adapted such that it may then be pivoted about its first end to be used as a pivot arm for opening the cover.

2. A device as in claim 1, wherein the biasing member is a spring under compression.

3. A device as in claim 1, wherein the pivot rod has means for adjusting its length.

4. A device as in claim 1, wherein the first means includes a set ring adapted to be force fit against the skirt.

5. A device as in claim 4, further comprising means attached to the set ring adapted for releasably locking the cover in the seated position.

6. A device as in claim 1, wherein the second means comprises a mounting assembly adapted for fixing to the underside of the manhole cover.

7. A combination of a manhole cover opening device, a manhole cover, and a means for defining an opening for the manhole cover to cover, the combination comprising:

a manhole cover;

means for defining an opening for the manhole cover to cover; and a manhole cover opening device comprising:

an elongate member having a first end and a second end;

first means for pivotably attaching the first end of the elongate member to the means for defining;

second means for pivotably attaching the elongate member to the cover proximate the second end;

means for biasing the manhole cover to rotate in a first direction about a point of contact of the manhole cover and means for defining; and wherein the manhole cover is further rotatable in a second direction about the first end of the elongate member.

8. The combination of claim 7, further comprising means for stopping rotation of the manhole cover in the first direction at a predetermined position.

9. The combination of claim 8, wherein the means for stopping comprises the second end of the elongate member.

10. The combination of claim 7, further comprising a handle attached to a top of the manhole cover.

11. The combination of claim 7, wherein the means for biasing comprises a spring.

12. The combination of claim 7, wherein the means for biasing has a first end and a second end which are pivotably attached to the first means and the second means, respectively.

13. The combination of claim 7, wherein the elongate member has means for adjusting its length.

14. The combination of claim 7, wherein the first means includes a set ring force fit against the means for defining.

15. The combination of claim 14, further comprising means attached to the means for defining and manhole cover for releasably locking the manhole cover in a closed position.

16. The combination of claim 7, wherein the means for biasing has a biasing force acting on the manhole cover when the manhole cover is in a closed position of less than a force needed to rotate the manhole cover in the first direction.

17. The combination of claim 7, wherein the means for defining includes a skirt for seating the manhole cover.

* * * * *